United States Patent [19]

Antenore

[11] 4,079,364

[45] Mar. 14, 1978

[54] WATER SAFETY ALARM APPARATUS

[75] Inventor: Ronald L. Antenore, Coral Gables, Fla.

[73] Assignee: James D. Pauls & Associates, Ltd., Miami, Fla.

[21] Appl. No.: 713,372

[22] Filed: Aug. 11, 1976

[51] Int. Cl.[2] ..... G08B 21/00

[52] U.S. Cl. ..... 340/279; 9/313; 340/235; 340/421

[58] Field of Search ..... 340/279, 421, 235; 9/14, 313

[56] References Cited

U.S. PATENT DOCUMENTS

| | | | |
|---|---|---|---|
| 1,574,485 | 2/1926 | Hylard | 9/14 |
| 3,638,258 | 2/1972 | Black | 9/313 |
| 3,810,146 | 5/1974 | Lieb | 340/279 |

*Primary Examiner*—Glen R. Swann, III
*Attorney, Agent, or Firm*—Shoemaker and Mattare, Ltd.

[57] ABSTRACT

An alarm apparatus which is activated upon immersion. The apparatus is adapted to be worn whenever the wearer is expected to be in the proximity of a body of open water and will sound an alarm should that wearer fall into the water. The apparatus is portable, self-contained and has a water activated release to automatically release the apparatus from the wearer upon immersion of the device. The alarm is mounted in a buoyant housing so that housing is self-righting to float to the surface of the water in an upright orientation so the alarm signal is emitted outwardly of the water when the housing reaches the surface. Various embodiments and actuating and release circuits are also disclosed.

36 Claims, 17 Drawing Figures

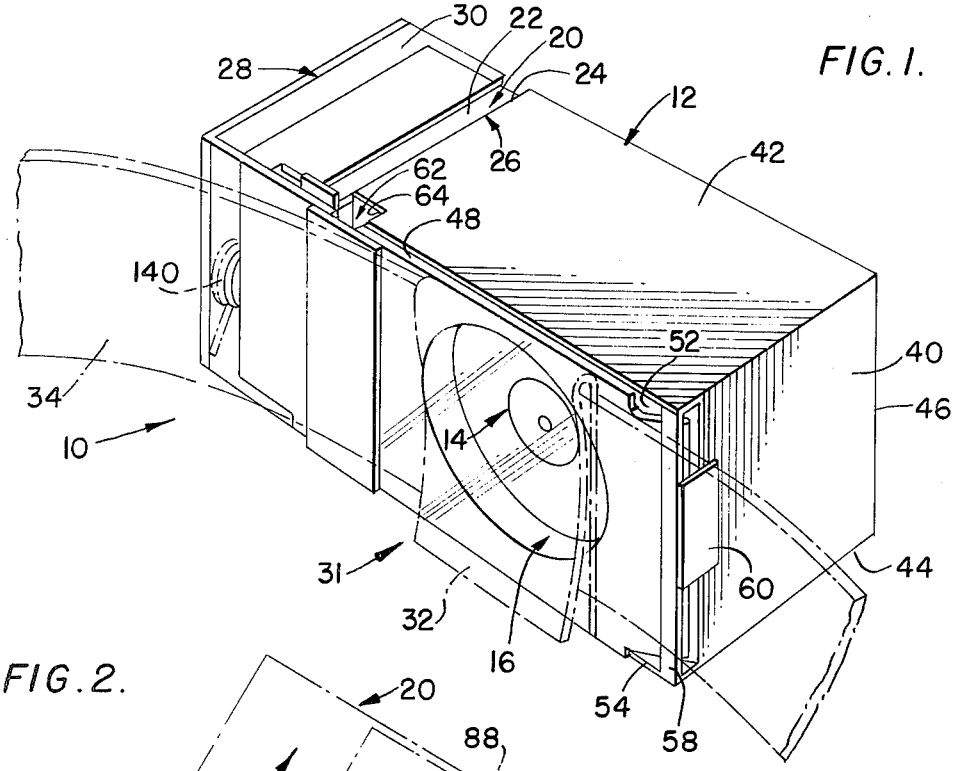
FIG. 1.
FIG. 2.
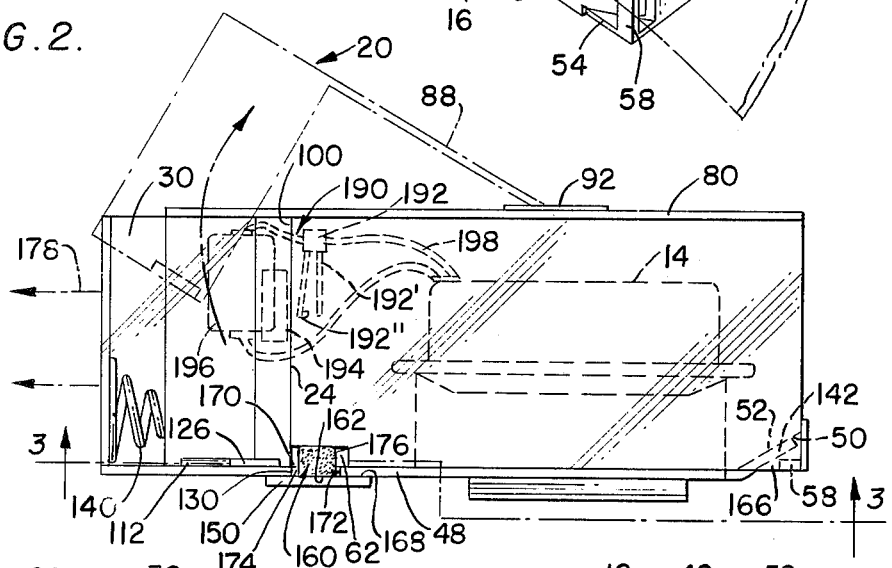
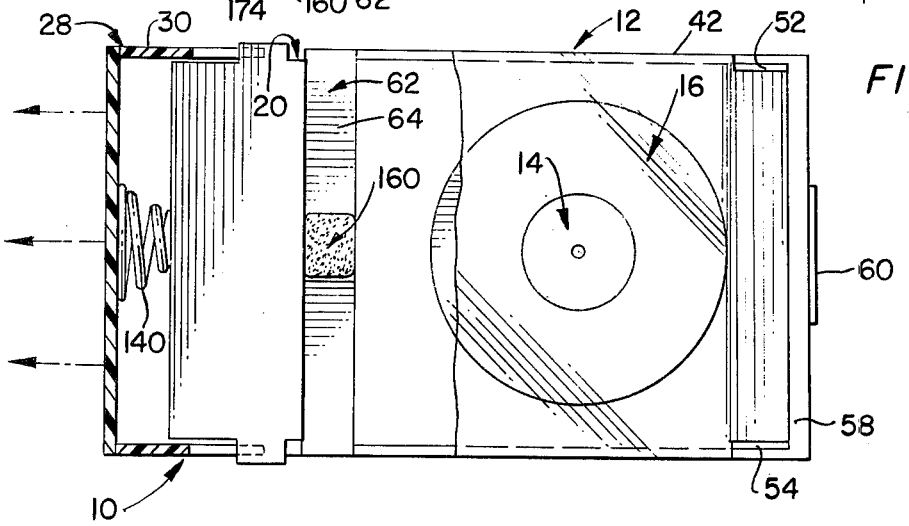
FIG. 3.

FIG. 7.
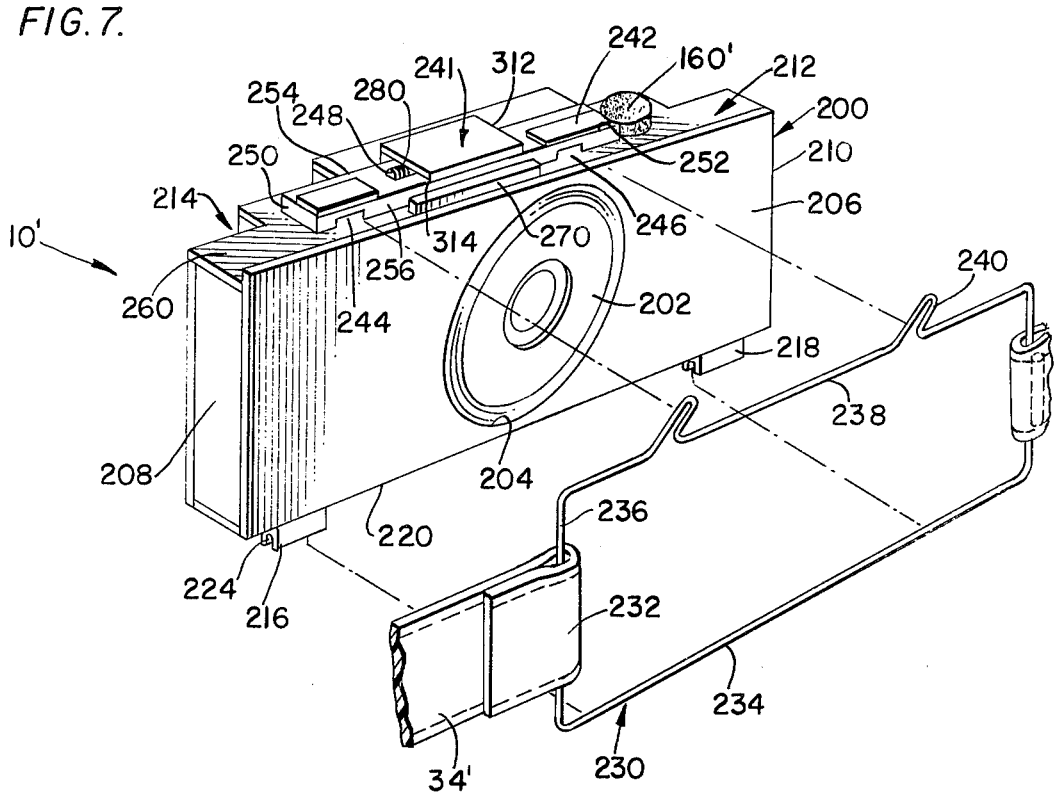
FIG. 8.
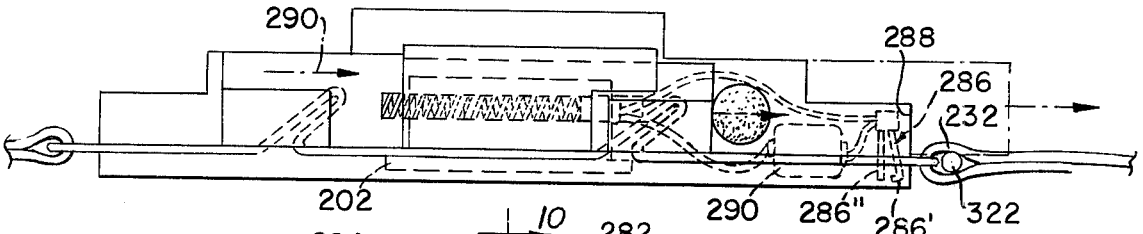
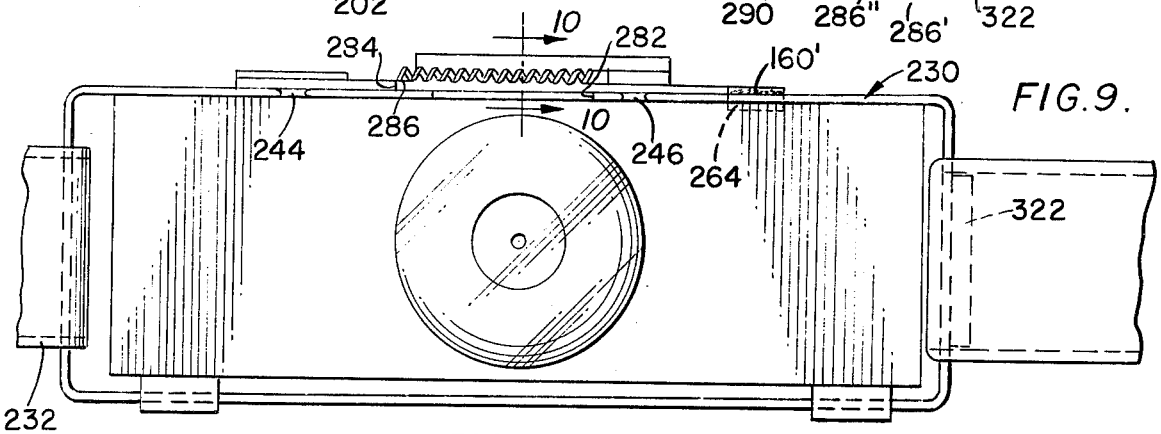
FIG. 9.
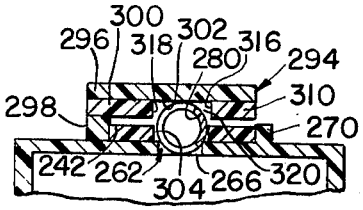
FIG. 10.

WATER SAFETY ALARM APPARATUS

BACKGROUND OF THE INVENTION

The present invention relates in general to alarm systems, and, more particularly, relates to an alarm apparatus used in conjunction with water safety.

In the United States and foreign countries, the ever increasing popularity of water related sports and activities has resulted in a proliferation of swimming pools, boats and water proximate homes. Accompanying this proliferation of water-related activities has been an alarming number of water-related accidents. Such accidents represent a constant source of anxiety to all owners of equipment which may expose a non-swimmer, or even a strong swimmer who for some reason may not be able to swim, to an open body of water.

The most traumatic of these water-related accidents is the accidental drowning of a swimmer, and by far the most tragic of these is the drowning of a small child. It has been estimated by various sources that a child is most susceptible to drowning when that child is under five years of age. Such young children are difficult to protect, as they are active, inquisitive, unpredictable and often forget any training, either safety related or swimming skill related, in times of panic.

With over a billion swimming pools in the United States alone, and untold numbers of boats and ships, as well as vast amounts of waterside property, serious attention must be directed at preventing, to as great a degree as possible, such tragedies.

It is evident that life preservers, fences and other similar presently available equipment has not proven to be adequate to prevent such water-related accidents as, in spite of the existence and ready availability of such safety equipment, the number of water-related accidents still remains at an intolerably high level. The often cumbersome and confining nature of the floating devices represents the primary drawback thereof. These devices, therefore, are not conducive for wear, especially for small children. Fences and the like require preventive action to be taken by the pool owner. Such preventive action may be adequate in a usual case, but not for all cases, and there are many documented instances where a child simply climbs over the fence, and thereby exposes himself to the danger of an unattended pool. Accordingly, another protective means which will be conducive to use by all, but especially to use by small children, is required.

There are known devices adapted to be worn, and which activate an alarm upon the wearer's entry into the water. One such device is adapted for use near swimming pools and includes a transmitter attached to the wearer's clothes and which cooperates with a receiver mounted near the pool. The receiver is connected to the water of that pool, and upon immersion, the transmitter becomes operative and actuates the receiver. The receiver is connected to an alarm signalling device and operates that device upon receiving a signal from the transmitter. Because the range of the transmitter is limited, such a device is not useful on board a boat or in conjunction with a large body of water, such as a lake, or the like. Furthermore, such a device requires a pool owner to install and maintain expensive equipment, thereby further increasing the costs of an already expensive item.

Another known device requires the wearer to take positive action in order to separate the signalling device from his person. An immediately evident drawback to such a device is the requirement for a rational, thoughtful action by a drowning person. Obviously such action will not be taken by a drowning person, who most likely will be panicked, and especially if such a person is a small child under five years of age, even if such a child could be taught to use the device.

The present invention provides a small, self-contained and self-actuating alarm signalling unit which is worn on the person. The unit may also be used for pet protection, i.e., attached to dog or cat collars.

SUMMARY OF THE INVENTION

The apparatus embodying the present invention can be readily worn by persons of all ages, will sound an alarm in any size body of water and does not require the wearer to take any action to activate the alarm.

The apparatus comprises means for attaching the alarm signal producing unit to the wearer's body and includes a water-activated release mechanism. Upon immersion of the apparatus, the release mechanism quickly and automatically releases the alarm signal producing unit from the wearer. The alarm unit includes a horn or other alarm signal producing device therein which is activated almost simultaneously with the separation of the unit from the wearer. The unit is buoyant and weighted to be self-righting so that, upon release from the wearer, the unit floats to the surface of the water with the horn, or other signalling device, assuming an operative position to be presented upwardly and outwardly of the water. The horn emits a signal which is audible for a wide area, and can be arranged to emit a signal at a frequency different from the sound of waves and/or shipboard equipment so the device can be used in conjunction with boats or waterside property. The horn can be replaced by, or used in conjunction with, visual indicators such as dye or smoke, to indicate the position of the device, and thus the position of the person in distress.

Preferably, the elements of the release mechanism which hold the unit to the wearer are biased to release that unit, and are held immobile against that bias by a water soluble tablet. The elements are freed to move into a releasing configuration when the tablet dissolves. Another form of release mechanism utilizes an electromechanical circuit, and yet another form of the release mechanism includes an electrothermal element. Both of these forms include a circuit which activates the alarm signalling device at the same time the release mechanism is activated; whereas the other forms of the unit have alarms which are activated after the unit is released and as the unit leaves the proximity of the wearer.

The device embodying the present invention is therefore amenable to be worn by children or adults in areas near the open bodies of water. The device is self-contained so that the owner or other person responsible for the body of water, or property proximate thereto, need not install additional equipment which is of limited range and use. The device is self-actuating and accordingly does not require a drowning person to take any positive, rational action, thereby virtually eliminating the possibility that a panicked person will neglect to actuate the alarm signal producing unit.

The device is easily adapted to emit a wide variety of visual and/or audio signals so that it is amenable for use in the ever widening range of situations which is accompanying the proliferation of water-related activities in this and foreign countries.

The unit can also be used in conjunction with other safety equipment, such as life jackets and life preservers, and can be manufactured in a wide variety of colors, sizes and shapes to fit nearly every conceivable situation and fashion. For example, various famous and child-appealing personalities, or cartoon characters, or other decorative shapes and ornamentations can be used to induce small children to wear the unit.

Use of the apparatus embodying the present invention will relieve much of the anxiety of parents of small children, as well as the anxiety experienced by owners of water proximate property.

OBJECTS OF THE INVENTION

It is accordingly a main object of the present invention to provide a wearable, water-activated alarm system which is self-contained.

Another object of the present invention is to provide a wearable, water-activated alarm system which is self-actuating.

A further object of the present invention is to provide a wearable, water-activated alarm system which is conducive to use by small children.

Yet another object of the present invention is to provide a wearable, water-activated alarm system which is self-righting into an operative position.

Yet a further object of the present invention is to provide a wearable, water-activated alarm system which is amenable to use with all bodies of open water.

Still another object of the present invention is to provide a wearable, water-activated alarm system which is adaptable to be used in conjunction with other water-safety equipment.

These together with other objects and advantages which will become subsequently apparent reside in the details of construction and operation as more fully hereinafter described and claimed, reference being had to the accompanying drawings forming part hereof, wherein like reference numerals refer to like parts throughout.

BRIEF DESCRIPTION OF THE DRAWINGS

FIG. 1 is a perspective view of a first form of the apparatus embodying the teachings of the present invention.

FIG. 2 is an elevation of the FIG. 1 embodiment, showing that apparatus in an inverted orientation.

FIG. 3 is a plan view taken along line 3—3 of FIG. 2.

FIG. 7 is a perspective view of a second form of the apparatus embodying the teachings of the present invention.

FIG. 8 is a plan view of the FIG. 7 embodiment.

FIG. 9 is an elevation view of the FIG. 7 embodiment.

FIG. 10 is an end elevation taken along line 10—10 of FIG. 9.

DETAILED DESCRIPTION OF THE PREFERRED EMBODIMENTS

Figure 4:
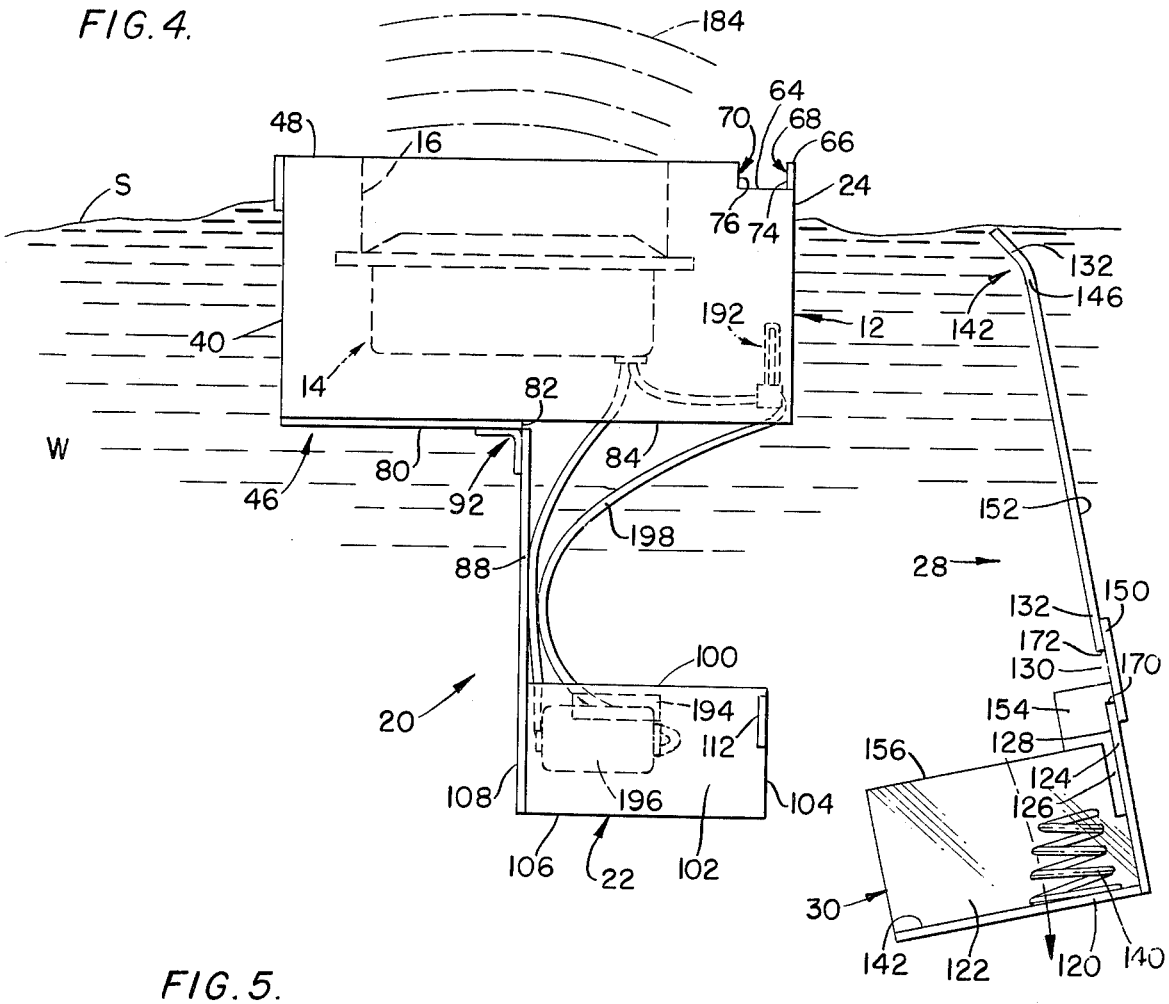
FIG. 4 is an elevation view showing the FIG. 1 apparatus operatively positioned in the body of water.

Shown in FIG. 1 is an apparatus 10 for sounding an alert that a wearer of that apparatus has fallen into a body of water and may be in distress, or in imminent danger of drowning. The preferred form of the apparatus comprises a water-tight housing 12 having a speaker or horn 14 mounted in a speaker well 16. Covering the portal of the well 16 is a water-tight film-like protector. A dropleaf-type appendage 20 is pivotally connected to the housing 12 and has a housing 22 held against wall 24 defining end 26 of the housing 12 by a cradle device 28 having a hood 30 which receives therein the housing 22 to position same against the wall 24 for purposes which will be later discussed. The apparatus 10 is adapted to be connected to a wearer by an attaching means 31, such as a belt connection which is shown schematically in FIG. 1 as a spring clasp 32 mounted on the cradle 28 and adapted to releasably engage a belt 34, or the like. The belt can be specially manufactured, or can be an ordinary belt, as desired.

It is here noted that the directions, up, down, and the like, are taken in reference to the operative, alarm-signalling orientation of the apparatus.

The material used to manufacture the apparatus 10 is selected so that the apparatus is buoyant, and has sufficient buoyancy to cause the released unit to rise to the surface of the water rapidly. The buoyant force causes the apparatus to float to the surface where the horn emits an audible alarm signal. As will be later discussed, the device is weighted to be self-righting so that regardless of the orientation of the unit at the time of release, the horn portal always assumes an operative orientation so that the horn is upwardly directed with respect to the surface of the water, thereby permitting the alarm to be emitted away from the surface of the water.

The speaker housing is best shown in FIGS. 1 and 2 and is elongate with a free end defined by a wall 40 connected to side defining walls 42 and 44 and to bottom defining wall 46, which are connected to the end wall 26 to form a closed, water-tight compartment in which the horn 14 is housed. Front, or top face defining wall 48 has the horn portal defined therein, and is best shown in FIGS. 1 and 3. The front wall 48 has a declining ramp 52 defined therein adjacent the wall 40 and interconnecting the walls 40 and 48. The upper corners of walls 42 and 44 which are located adjacent ramp 52 are located to be coplanar with wall 40 to define marginal walls adjacent the ramp 52, such as wall 54. Spanning the ramp and connected to the marginal walls is a tie slat 58 which has a connecting plate 60 located approximately intermediate the ends thereof and which is connected to the wall 40 to provide support to the slat 58 and to act as a stop for the cradle 28, as will be later discussed.

Defined in the housing 12 adjacent wall 24 is a slot 62 which extends transversely of the housing and has one end defined in wall 42 and the other end defined in wall 44. The wall 24 extends upwardly above floor 64 of the slot, so that the upper terminal edge 66 (FIG. 4) of the wall 24 is located approximately coplanarly with front face defining wall 48 so that the slot has side walls 68 and 70 defined by inner surface 74 of end wall 24 and ledge 76 which connects the floor 64 and the face wall 48. The function and operation of this slot will be later discussed.

As best shown in FIG. 4, the bottom wall 46 comprises a first section 80 located adjacent free end wall 40 and which extends toward wall 24 so that the section has an edge 82 which is located between those walls and which extends transversely of the housing 12. A second section 84 of the wall 46 is upwardly offset from section 80 and extends from contiguous edge 82 to wall 24 to which it is connected.

The dropleaf appendage 20 has a support arm 88 pivotally connected to the section 80 by a hinge 92 so that, when the housing 22 of the dropleaf is located in a first position adjacent wall 24, as shown in FIG. 1, the arm 88 and the section 80 are coplanar with each other. The hinge 92 can be of any suitable material which allows the dropleaf to swing freely into a second position, as shown in FIG. 4, when that dropleaf is released.

The dropleaf housing 22 is heavier than water, and hence it is sinkable, and comprises an inner end defining wall 100, side walls, such as side wall 102, a top defining wall 104 and an outer end defining wall 106 and a bottom defining wall 108, which is formed by the support arm 88. In the operative, FIG. 1, position, the housing 22 is located contiguous end wall 24 and extends transversely of the housing 20, i.e., the length of the housing 22 corresponds to the width of the housing 20. The length of the housing 22 is less than the width of the housing 20 so that side walls 102 are offset inwardly from the side walls 44 and 42 of the housing 20. A pair of side tabs, such as tab 112 shown in FIG. 4, are connected to the top wall 104 and extend outwardly thereof so that the outer tips of those tabs are located slightly beyond the walls 42 and 44. The tabs are used as guides when placing the cradle 28 in the operative position shown in FIG. 1.

The cradle 28 is best shown in FIG. 4 and the hood 30 comprises free end defining wall 120, side defining walls, such as wall 122, which have one end edge free and the other end edge connected to a cover arm 124 adjacent the wall 120. One of the end edges of the wall 122 is partially removed to define a slot 126 between inner surface 128 of the arm 124 and the end edge of the wall 122. A slot 130 is defined in the arm 124 at a location spaced from the housing 30 and extends from side edge 132 of the arm transversely thereof to a location between the two side edges of the arm 124. Preferably, the slot has a curved end (not shown) defined in the arm 124. An ejector spring 140 is seated on inner surface 142 of wall 120 and extends away from that wall to engage the outer surface of housing 22.

The other end of the arm is curved to form a locking tongue 142 which is adapted to engage the slot defined by ramp 50 and slat 58. Accordingly, the side edges 132 of the tongue are stepped so that the tongue has a width less than that of the body of the arm, this inward offset being indicated in FIG. 4 by the edge 146 defined at the intersection of the tongue and the body of the arm 124.

A spanner plate 150 is mounted on outside surface 152 of the arm 124 to cover the slot 130. An arm 154 is mounted on the outer surface of one of the side walls and covers the slot defined therein and extends beyond edge 156 of the hood toward the wall 24 to encase the housing 12.

As shown in FIG. 2, a water soluble tablet 160 is located in the slot 62 and is essentially rectangular in cross-section with a width approximately equal to the width of the slot 62 and a thickness slightly greater than the depth of the slot, so that the top facial surface 162 of the tablet is located slightly above the plane of the wall 48. As shown in FIG. 2, when the cradle is operatively positioned with the hood thereof receiving the housing 22 and the tongue received in the restraining mouth 166 defined by slat 58 and ramp 50, the tablet is engaged in slot 130 with surface 162 engaged against inner surface 168 of the spanner plate 150. The slot 130 has a width approximately equal to the width of the tablet, so that inner opposed edges 170 and 172 of the slot are engaged against oppositely presented side faces 174 and 176 of the tablet, respectively. By interpositioning the tablet so that the side edges thereof are engaged with the side edges of the slot 62 as well as with the edges of the slot 130 as above discussed, those edges are all mechanically coupled together via the tablet and are thus immovably located with respect to each other due to the wedging or jamming action of the tablet.

As shown in FIG. 2, the spring 140 is sized to be compressed when the housing 22 is received in the hood, thus the spring continuously urges the hood, and hence the cradle, in the direction indicated by arrows 178 in FIG. 2, which for the purposes of convenience will be termed the ejecting direction. As shown in FIG. 2, when the cradle is operatively positioned, the tabs 112 are received in the guide slots 126 of the hood 30.

By the interengagement of the sides of the slots 62 and 130 and the registration of the tongue 142 in the restraining mouth 166, as well as the registration of the tabs 112 in the slots 126, the cradle is held onto the housing 20, and hence the dropleaf housing 22 is held against the housing 12 by the hood, as shown in FIG. 2. The spring 140 applies a continuous ejecting force to the cradle which is resisted by the engagement of the slot sides against the sides of the tablet 160.

As the tablet is water soluble, upon immersion of the apparatus 10 in a body of water "W", as shown in FIG. 4, the tablet dissolves, thus freeing the cradle from connection to the housing, and the spring causes the housing to be ejected from the cradle, and hence away from connection with the wearer's body. This is indicated by the relative orientation of the elements in FIG. 4. Once the housing is free of the cradle, the dropleaf, being sinkable, is unsupported and freed to swing downwardly into the position shown in FIG. 4 beneath the housing 12. The buoyant forces applied to the housing 12 cause the apparatus to float and rise to the surface "S" of the water, and the positions of the dropleaf housing 22 below the housing 12 lowers the center of gravity of the apparatus beneath the housing 12 so that no matter what orientation the unit has at release, the housing always assumes the position shown in FIG. 4 with the horn portal presented upwardly so that the alarm signal emitted thereby, as indicated by lines 184 in FIG. 4, will be directed away from the water surface "S" and thus be detectable by those able to effect a rescue of the person wearing the apparatus.

The circuitry of the apparatus is indicated in a general manner by the arrow 190 in FIG. 2 and comprises a magnetically operated reed switch, indicated schematically by the numeral 192, located adjacent wall 24 on the inside of the housing 12, a magnet 194 located adjacent wall 100 on the inside of housing 22 to operate the contacts 192' and 192'' of the switch 192 when the housing 22 is located adjacent housing 12 with the walls 24 and 100 in abutting contact, as will be the case when the cradle is operatively positioned on the apparatus to hold the dropleaf in the hood 30 prior to ejection thereof by the spring, as above discussed. A battery 196 is also located within the housing 22, and leads 198 electrically interconnect the circuit elements together. The reed switch is held open, thus opening the circuit, by the magnet 194 when the dropleaf is held up by the cradle in the operative position shown in FIGS. 1–3. However, upon immersion of the apparatus, the tablet 160 dissolves, allowing the spring to eject the unit from the cradle which allows the dropleaf to swing downwardly to remove the magnet 194 from the proximity of the reed switch which, in turn, enables the natural resiliency of the contacts of that switch to close the switch (as shown in FIG. 4) thus completing the circuit between the battery and the horn to activate the horn and emit the distress signal, which is emitted as indicated by the numeral 184 when the horn reaches the surface. The activated system is shown in FIG. 4, with the reed switch in the closed position to complete the circuit between the horn and the power source, and the magnet housing suspended beneath the horn housing, with that horn housing in the operative position to emit the alarm outwardly of the water.

The tablet can be formed of any material which is rapidly dissolvable, and the apparatus is formed of materials which enable that apparatus to reach the surface of the water quickly, as people, especially children, have been known to drown within 15 seconds of their immersion. Thus, the spring should be of sufficient strength to eject the unit from the cradle as quickly as possible. The materials of the apparatus embodying the teachings of the present invention should also be rugged and able to withstand the hard usage which would be expected from children, as they will be the primary users of the apparatus.

Alternatively, the clasp 32 could be replaced by an attaching means formed of a dissolvable material, so that the apparatus is quickly freed from the wearer.

An alternative embodiment of the present invention is indicated by the reference numeral 10' in FIGS. 7–10. The apparatus 10' comprises a housing 200 having an alarm signal emitting device, such as a horn 202, located therewithin and held in a speaker well 204 defined in a top or front wall 206. The housing comprises a pair of end defining walls 208 and 210, and a side defining wall 212 and a stepped bottom or back defining wall 214. A pair of mounting brackets 216 and 218 are mounted on a side defining wall 220 of the housing 200. Each mounting bracket has a wire receiving slot 224 defined therein to be presented outwardly of the housing.

The apparatus 10' is releasably mounted in a harness 230 attached by loops 232 to a belt 34' worn by a user. The harness comprises a base 234, ends 236 and a side 238. A pair of mounting fingers 240 are defined on the side 238 and are releasably connected to the housing 200 to mount that housing on the harness 230. Preferably, the fingers 240 are oriented on the belt to be presented away from the wearer when in use.

The apparatus used to releasably mount the housing 200 onto the harness 230 is indicated by the reference numeral 241. Mounting apparatus 241 comprises an elongate sliding arm, or slide 242 having defined therein a pair of mounting finger receiving slots 244 and 246 which are spaced and oriented to snugly receive therein the mounting fingers 240. Also defined in the slide 242 is an elongate aperture 248 oriented to be longitudinally aligned with the slide 242 and to have the geometric center thereof centrally positioned between slide ends 250 and 252, slots 244 and 246 and slide sides 254 and 256.

Outer surface 260 of the wall 212 has defined therein an elongate slot 262 (FIG. 10) and a tablet receiving mounting well 264 which has a tablet mounting plate extending thereacross and mounted on the inner surface of the wall 212 inside the housing to hold a tablet 160' in the well 264. A mounting plate 266 is also mounted on the inside surface of wall 212 to cover the slot 262. The well 264 is located adjacent slot 262 and the slot 262 has a width approximately equal to the width of slot 248, but a length somewhat less than that slot 248.

Defined on surface 260 adjacent slot 262 is an elongate, outwardly projecting guide ledge 270 which is longitudinally aligned with, though longitudinally and transversely offset from, the slot 262.

As shown in FIG. 10, a compression spring 280 is positioned in slot 262, and the slot 242 is positioned so that the slot 248 coincides with the slot 262 to receive the spring 280 in slot 248 with the ends of the spring seated against end edges 282 and 284 of slot 262 and end edge 286 of the slot 248. When the arm is moved to the left as shown in FIG. 7, the spring is compressed and exerts a force on that slide in the direction of arrow 290 in FIG. 8, which will hereinafter be referred to as the releasing direction.

A guide bracket 294 has an outer wall 296 with a path defining ledge 298 attached to a mounting strip 300 which, in turn, is secured to undersurface 302 of housing wall 296. The ledge 298 depends from the strip 300 and is located closely adjacent side 304 of the slot 262. Located adjacent the other side edge of the bracket 294 is another strip 310 mounted to extend along that edge. The strip 310 is elongated and is coaxial with the wall 296 and strip 300 but extends for only a portion of the length of the top, that is, the strip 310 has an end edge coplanar with side edge 312 of the bracket wall 296 and another end edge located between end edge 312 and end edge 314 of the bracket 294. The inner edge 316 of the strip 310, along with inner edge 318 of the strip 300, define an elongated path 320 and are spaced apart a distance somewhat greater than the width of the spring so the spring and slide can be guided on top of the housing 200.

The bracket 294 is mounted as shown in FIG. 10 with ledge 298 located adjacent slide 242 with the slide received adjacent the path 320. The slide is moved in a direction opposite to the releasing direction, thus compressing the spring, and tablet 160' is positioned in the tablet mounting well to be engaged by slide end 252 and thus hold the slide in the cocked position in FIG. 7. With the slide thus cocked, the fingers 240 are held in the slots 244 to capture harness top 238 between the slide and the housing wall 212. The mounting brackets are mounted on the harness to thus releasably mount the apparatus 10' in the harness.

Upon immersion of the apparatus 10', the tablet 160 dissolves, thereby releasing the slide which is moved out of the cocked position by the spring 280. The movement of the slide moves the slots 244 off of the fingers 240, thereby releasing the apparatus from the harness 230. The slots 244 and the fingers 240 can be shaped and inclined with respect to the transverse axis of the slide 242, so that when the slide moves in the releasing direction, the slide pushes against the fingers and thus gives the housing a slight push away from the harness. This inclined orientation is indicated in FIG. 7 for the fingers 240.

As in the FIG. 1 embodiment, the apparatus is buoyant and upon release from the harness 230 immediately begins to float upwardly toward the surface of the water, and away from the harness. A magnet 322 is positioned in one of the loops 232 to be next to the end wall 210 of the housing.

As in the FIG. 1 embodiment, the horn 202 is part of a circuit which includes a magnetically operated reed switch 286 located immediately adjacent inner surface 288 of the wall 210, and having flexible contacts 286' and 286'' which are held apart by the magnet 322 which attracts contact 286' away from contact 286'' and thus maintains the switch, hence the circuit, open and prevents energization of the horn 202 by a battery 290 via the circuit.

Once the device is immersed, the tablet dissolves, thus freeing the slide to move into a released position to release the apparatus 10' from the harness 230, and allow the apparatus to float away therefrom and hence to remove the reed switch from the proximity of the magnet 322. Once the switch is out of the influence of the magnet, it closes, thus completing the circuit and actuating the horn, which immediately, as in all embodiments of the present invention, begins to emit a distress signal.

The horn and the battery of the FIG. 7 embodiment are oriented so that the center of gravity of the apparatus is beneath the geometric center thereof as the apparatus floats upwardly toward the surface, so that the horn will be operatively presented outwardly and emit the signal away from the water, as in the FIG. 1 embodiment.

Again, the tablet is a fast dissolving material, and the apparatus is water-tight and very buoyant so that the alarm signal is sounded as quickly as possible after the device is immersed in the water.

Figure 11:
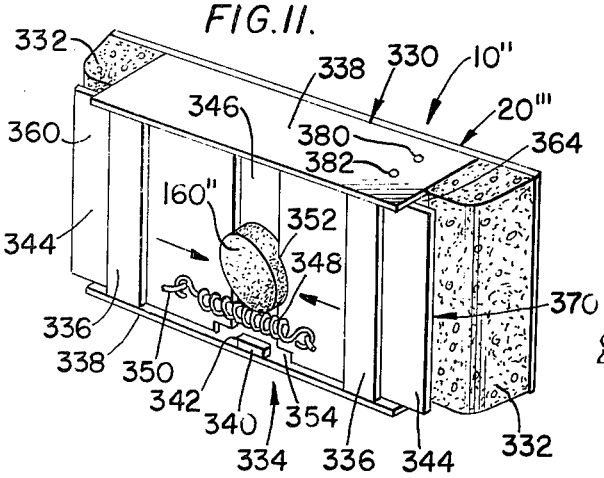
FIG. 11 is a perspective view of a third form of the apparatus embodying the teachings of the present invention.
Figure 12:
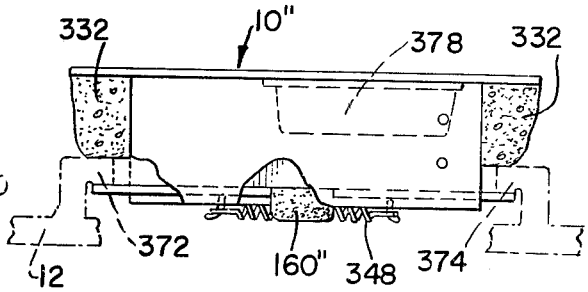
FIG. 12 is a plan view of the FIG. 11 embodiment connected to an attaching means.
Figure 13:
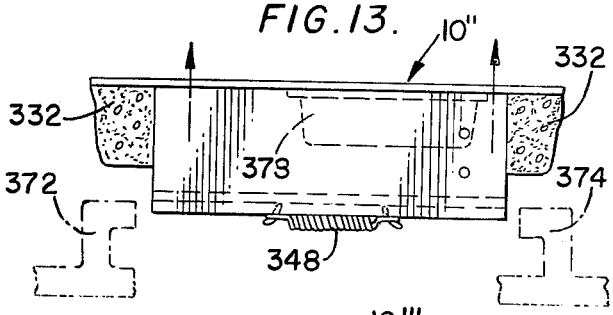
FIG. 13 is a plan view of the FIG. 11 embodiment released from the attaching means.

Yet another embodiment of the present invention is shown in FIGS. 11–13, and is denoted by the reference numeral 10''. The apparatus 10'' comprises a housing 330 having a pair of buoyant structures, or floats 332, on each end thereof. The floats are constructed of material such as foam so that the apparatus will quickly float to the surface upon release thereof.

The attaching mechanism of the present embodiment is denoted by the numeral 334 and comprises a pair of struts 336 connected at each of their ends to side defining walls 338 of the housing 330. A stop protuberance 340 is mounted on inner surface 342 of one of the side walls to be approximately medial thereof. A pair of sliding catch plates 344 are slidably mounted between the struts and a housing bottom defining wall 346 to slide coplanarly with each other and in a plane essentially parallel with the plane of the wall 346 in the direction indicated by the arrows in FIG. 11, which is the releasing direction.

A spring 348 is affixed at each of the ends thereof to one of the plates by mounting hooks, such as hook 350. Each plate has an arcuate slot, such as slot 352, defined in an end edge so that the arcuate slots are presented in opposition to each other.

A dissolvable tablet 160'' is essentially cylindrically shaped and is interpositioned between the plates so that the arcuate side surface of the tablet is received in the arcuate slots on the plates. When the tablet is interposed between the plates, the spring is stretched so that it urges the plates together in the releasing direction, but is resisted by the tablet and the plates are held immobile thereby.

The plates each have a cutout portion such as portion 354 defined therein to abut the stop 340 when the plate end edges are in abutting contact with each other.

The plates are sized so that when the tablet is interposed between them, each plate has a marginal end, such as end 360, extended beyond the end edges, such as end edge 364, of the wall 346 to form catching slots, such as slot 370, for trapping locking flanges 372 and 374 as shown in FIG. 12. The locking flanges are mounted on a belt, such as belt 34, worn by a user and are sized to be snugly trapped in the locking slots so that the apparatus will not fall off the wearer during normal use.

Thus, as soon as the apparatus is immersed, the tablet dissolves and the spring causes the locking plates to move toward each other, as shown in FIG. 13, thus moving the marginal ends thereof out of contact with the locking flanges to free the apparatus from engagement with the wearer and allow that apparatus to float freely away from the wearer.

The apparatus 10'' comprises a signal horn 378 which is activated by a water completed circuit comprising spaced apart contacts 380 and 382. A circuit which may be used to actuate the horn is disclosed in U.S. Pat. No. 3,810,146. Again, the circuit elements are distributed so that the apparatus will be self-righting to operatively orient the horn in an orientation so that it is presented away from the water surface when the apparatus reaches the surface. The same considerations of buoyancy and rapid dissolving of the tablet are present in the FIG. 11 embodiment as were present in the other embodiments.

Figure 16:
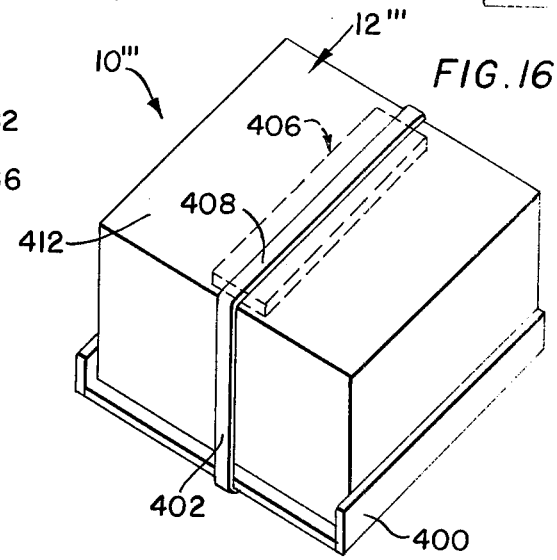
FIG. 16 is a perspective view of a fifth form of the apparatus embodying the present invention.

Yet another embodiment of the present invention is shown in FIG. 16, and is denoted by the numeral 10'''. The apparatus 10''' comprises a water-tight housing 12''' connected by a holder 400 to a wearer. The holder is releasably attached to the housing by a retaining strap 402 which encircles the holder approximately medially thereof for purposes of balance. A releasing means 406 comprises a heat sensitive portion 408 of the retaining strap, which is preferably plastic. A plastic, waterproof membrane covers the strap portion 408 and a smoke producing chemical is retained beneath that membrane between the strap and the outer surface 412 of the housing.

Figure 17:
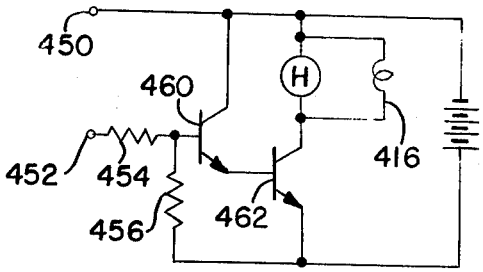
FIG. 17 is a schematic representation of a circuit which can be used in conjunction with the FIG. 16 embodiment.

The circuit contained within the housing includes an igniter, such as igniter 416 in FIG. 17, which is activated upon immersion of the housing and which generates sufficient heat to burn the plastic coating, which in turn, ignites the smoke producing chemical contained under the plastic membrane, which produces heat and smoke. The heat melts the membrane and the strap portion 408 and the apparatus is released from the holder. As in the other embodiments, the housing floats free and is arranged to be self-righting. In addition to the heat and smoke, the apparatus comprises a horn which emits an alarm signal.

Alternatively, the FIG. 16 releasing means could be used with any of the other embodiments to release the housing from the wearer. Upon separation of the housing from the wearer, the magnet actuated, or controlled, reed switches of the other embodiments would become operative, as above discussed.

Circuits suitable for use with the alarms embodying the present invention are shown in FIGS. 5, 6, 14, 15 and 17. All of the circuits are water activated, or completed, upon immersion thereof, and comprise spaced apart, water-sensitive electrodes 450 and 452 and resistors 454 and 456 connected to the base of a transistor 460. The horns used to audibly signal an alarm are indicated by the letter "H" in each of the figures, and the batteries which form the power source of the device are indicated by the letter "B".

Figure 5:
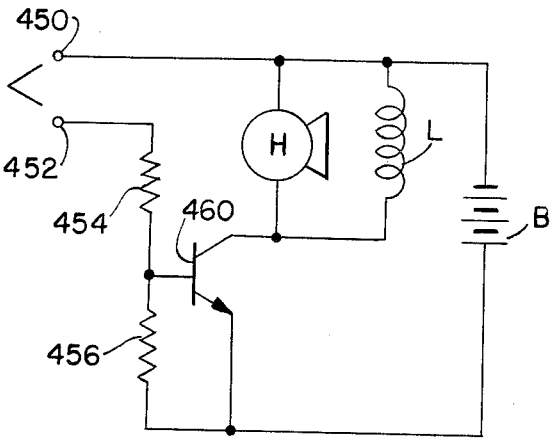
FIGS. 5 and 6 are schematic representations of circuits which can be used in conjunction with the devices embodying the teachings of the present invention.
Figure 6:
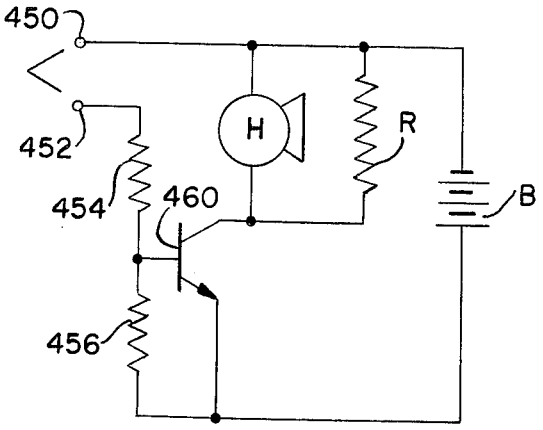

The FIG. 5 and 6 circuits, respectively, comprise an inductor "L" and a resistor "R" connected in parallel with the horn to the resistor for actuating that horn when the circuit is completed by the water. Thus, when the spaced electrodes enter the water, current is permitted to flow through the circuit into the base of the transistor 460, which begins to conduct current to either inductor "L" or resistor "R" essentially simultaneously with the activation of the horn "H".

Figure 15:
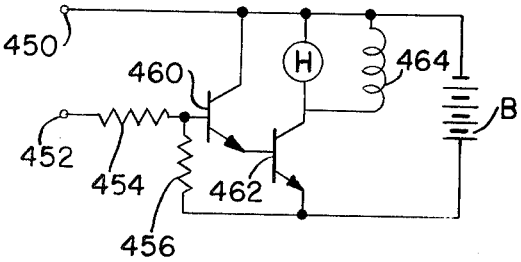
FIG. 15 is a schematic representation of a circuit which can be used in conjunction with the FIG. 14 embodiment.

The FIG. 15 and 17 circuits further comprise a second transistor 462 connected to the transistor 460 so that the two transistors form a Darlington pair. In both circuits, the horn is connected to the second transistor 462, and there is in FIGS. 15 and 16, respectively, connected in parallel with that horn to the transistor 462 an inductor 464 and a thermal resistor 416. As water completes the circuit by connecting the spaced electrodes together, current flows through the first transistor 460 turning this transistor on, which in turn, causes the second transistor 462 to saturate, thus conducting current to the horn and either the inductor or thermal resistor. As above discussed in reference to the FIG. 16 embodiment, the thermal resistor can be used to separate the alarm apparatus from the holder.

Figure 14:
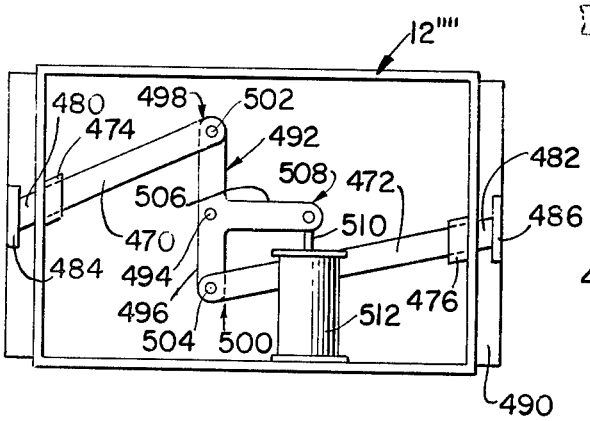
FIG. 14 is a perspective view of a fourth form of the apparatus embodying the teachings of the present invention.

The FIG. 15 circuit can be used in conjunction with a mechanical release, such as shown in FIG. 14. The mechanical release comprises a pair of locking arms 470 and 472 slidably mounted in a housing, such as 12'''', for example, by water-tight fittings 474 and 476, respectively. The arms extend outwardly of the housing to form locking fingers 480 and 482 respectively on the outboard ends thereof which are releasably engaged in keeper means 484 and 486 respectively on a body mounted holder worn by the user, such as a carriage or harness 490 mounted on a belt, such as belt 34. A "T" or double crank lever 492 is pivotally connected to the housing by a pivot pin 494 and is pivotally connected at the opposite ends of portion 496 to the inboard ends 498 and 500 of the locking arms 470 and 472 respectively by pivot pins 502 and 504. The lever 492 has a portion 506 having one end integral with portion 496 and a free end 508 pivotally connected to a moving arm 510 of a solenoid 512 which is mounted inside the housing. The solenoid 512 is indicated by the inductor 464 of the FIG. 15 circuit and will thus be actuated upon saturation of the transistor 462 as above discussed.

Upon actuation of the solenoid 512, the arm 510 is retracted, thus rotating the lever 492 in the clockwise direction about pivot pin 494. Such clockwise rotation of the lever 492 causes the locking arms to be withdrawn into the housing far enough to move the locking fingers out of engagement with the keepers, thus releasing the housing from the harness 490. Again, the housing is buoyant and self-righting to float to the surface of the housing with the alarm sounding horn presented upwardly and outwardly of that surface.

All of the circuits shown in FIGS. 15 and 16, and FIGS. 5 and 6, therefore activate the horn simultaneously with the activation of the release mechanism, and are thus alternative to the forms using the magnetically operated reed switches which activate when the unit has moved out of the proximity of a magnet.

It is noted that any of the devices embodying the present invention can be designed to emit a smoke marker or a marker dye in addition to sounding a horn. Further, the circuits disclosed are merely exemplary and are not intended as limitations, as other circuits can be used in conjunction with the self-righting devices herein disclosed. The batteries can be replaceable or rechargeable as desired, in which case, the housing will be suitably designed to be separable (yet water-tight) or to have recharging jacks thereon. The batteries will also be designed to hold a charge to sound an alarm of sufficient duration to ensure the arrival of help.

Thus, all of the devices embodying the present invention are quickly and automatically released from a wearer upon entry into the water, and all float quickly to the surface in an upright position to reliably and quickly sound an alarm signal. The rapidity and reliability with which these devices assume the alarm sounding orientation enables help to be quickly dispatched to the person in distress. As above discussed, such rapid and reliable alarm activation is extremely important because in many cases, especially if the person in distress is a small child, time is of the essence, and help must arrive with the utmost celerity.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A water safety alarm apparatus comprising:

a buoyant water-tight housing;

attaching means on said housing for attaching said housing to a wearer, said attaching means including water activated releasing means mounted on said housing which is automatically actuated upon immersion to disengage said housing from the wearer so that said housing floats free of the wearer and can rise to the surface of the water; and water activated alarm means mounted in said housing for signalling when said housing is immersed, said alarm means being positioned in said housing so that said housing floats in a predetermined orientation no matter what orientation said housing assumes when said releasing means is actuated.

2. A water safety alarm apparatus comprising:

a buoyant water-tight housing;

attaching means on said housing for attaching said housing to a wearer, said attaching means including biasing means on said attaching means urging said attaching means into a released position whereat said housing is released from said wearer, and a water deactivated bias resisting means connected to said attaching means to resist the urging of said biasing means, said bias resisting means being deactivated by water upon immersion, thereby permitting said biasing means to move said attaching means into a released position to release said housing from said wearer; and an alarm means connected to said housing for signalling when said housing is immersed, said alarm means being positioned in said housing so that said housing floats in a predetermined orientation no matter what orientation said housing assumes when said bias resisting means is deactivated.

3. A water safety alarm apparatus comprising:

a buoyant water-tight housing;

a sinkable housing which is adapted to sink upon immersion into water;

connecting means connecting said buoyant and sinkable housings together in a manner such that said sinkable housing can assume a first position immediately adjacent said buoyant housing and a second position spaced apart therefrom;

an alarm means mounted in said housings which emits an alarm signal whenever said sinkable housing is not in said first position;

a holder on said buoyant housing for holding said sinkable housing in said first position, said holder having biasing means thereon for urging said holder away from said buoyant housing;

attaching means on said holder for attaching said holder to a wearer; and water deactivated connecting means connecting said holder to said buoyant housing in opposition to the urging of said biasing means, said connecting means being deactivated upon immersion into water to disconnect said holder from said buoyant housing and thereby permit said biasing means to move said housings away from said holder, thereby causing said sinkable housing to move away from said first position, thereby actuating said alarm means, said alarm means being positioned in said housings so that said housings float in a predetermined orientation no matter what orientation said housings assume when said connecting means is deactivated, and said alarm means being positioned in said housings so that said buoyant housing is oriented with said alarm means presented to emit an alarm signal which is directed outwardly of the water when said buoyant housing reaches the water surface.

4. A water safety alarm apparatus comprising:

a buoyant water-tight housing;

a harness attachable to a wearer's body;

housing connecting means on said housing releasably connecting said housing to said harness, said connecting means including biasing means on said housing urging said attaching means into a releasing position to release said housing from said harness, and a water deactivated bias resisting means on said housing which resists the urging of said biasing means, said bias resisting means being deactivated by water upon immersion, thereby permitting said biasing means to move said attaching means into said releasing position to release said housing from said wearer; and an alarm means connected to said housing for signalling when said housing is immersed, said alarm means being positioned in said housing so that said housing floats in a predetermined orientation no matter what orientation said housing assumes when said bias resisting means is deactivated.

5. A water safety alarm apparatus comprising:

a buoyant water-tight housing;

attaching means on said housing for attaching said housing to a wearer, said attaching means including a strap and a strap separating means which is water activated to separate said strap and thereby release said housing from the wearer;

water activated alarm means mounted in said housing for signalling when said housing is immersed, said alarm means being positioned in said housing so that said housing floats in a predetermined orientation no matter what orientation said housing assumes when said strap separating means is activated.

6. The apparatus of claim 1, wherein said releasing means further includes a solenoid mounted in said housing, a pair of locking levers slidably mounted on said housing to extend outwardly of said housing into engagement with keeper means on the wearer for holding said housing on the wearer, said locking levers being retractable into said housing, and a pivot connecting said locking levers to said solenoid, said solenoid being connected to a water activated circuit to be actuated thereby, said pivot lever connecting said locking levers to said solenoid so that said locking levers are retracted into said housing upon actuation of said solenoid, thereby releasing said housing from the wearer.

7. The apparatus of claim 2, wherein said biasing means is a spring.

8. The apparatus of claim 2, wherein said bias resisting means is a water soluble tablet.

9. The apparatus of claim 1, wherein said alarm means is a horn.

10. The apparatus of claim 3, wherein said attaching means is a clasp mounted on said holder and adapted to engage a belt worn by the wearer.

11. The apparatus of claim 1, wherein said alarm means includes a magnetically actuated reed switch and a magnet which holds said reed switch open when said housing is attached to the wearer.

12. The apparatus of claim 3, wherein said alarm means includes a magnetically operated reed switch in said buoyant housing and a magnet in said sinkable housing which holds said reed switch open when said sinkable housing is in said first position.

13. The apparatus of claim 12, wherein said second position is located beneath said buoyant housing.

14. The apparatus of claim 3, wherein said holder includes a hood which receives therein said sinkable housing and a mounting arm, said hood being mounted on said arm at one end thereof, and a locking tongue on the other end of said arm.

15. The apparatus of claim 14, wherein said buoyant housing includes a locking tongue receiving means to receive therein said locking tongue.

16. The apparatus of claim 15, wherein said holder has a slot defined therein for receiving said water deactivated connecting means so that said holder is attached to said buoyant housing by said tongue and said water deactivated bias resisting means.

17. The apparatus of claim 4, wherein said housing connecting means includes a slide and a slide guide mounted on said housing, and said biasing means includes a spring interposed between said slide and said housing to urge said slide toward said releasing position.

18. The apparatus of claim 17, wherein said bias resisting means includes a water soluble tablet.

19. The apparatus of claim 18, wherein said harness includes a pair of spaced apart locking fingers, said slide having defined therein a pair of locking finger receiving slots, and said housing including a pair of harness engaging mounts attached thereto.

20. The apparatus of claim 19, wherein said alarm means includes a horn, a magnetically operated reed switch, connecting means connecting said horn to a power source when said reed switch is closed, and a magnet mounted in said harness in a position to hold said reed switch open when said housing is in said harness, said reed switch being biased toward a closed position so that when said housing is not in the proximity of said magnet, said reed switch is closed whereby said alarm is actuated.

21. The apparatus of claim 4, wherein said housing connecting means includes a pair of edgewise opposed slidable plates slidably mounted on said housing, said biasing means including a spring connecting said plates together and urging said plates toward each other, said bias resisting means being interposed between opposed edges of said plates to maintain them in spaced relation with respect to each other against the urging of said spring, said plates each having a free end located in spaced relation with said housing to define with said housing a locking gap, said harness including a plurality of locking flanges which are each received in a locking gap to connect said housing to said harness, said free ends moving out of said locking gaps to free said locking flanges when said plates move toward each other under the urging of said spring.

22. The apparatus of claim 21, wherein said bias resisting means includes a water soluble tablet.

23. The apparatus of claim 1, further including a water completed circuit mounted in said housing for connecting said alarm means to a power source when said housing is immersed.

24. The apparatus of claim 23, wherein said circuit includes a transistor connected to said alarm means and an inductor connected in parallel with said alarm means.

25. The apparatus of claim 23, wherein said circuit includes a transistor connected to said alarm means and an igniter connected in parallel with said alarm means.

26. The apparatus of claim 23, wherein said circuit includes a pair of transistors connected together to form a Darlington pair.

27. The apparatus of claim 26, wherein said circuit further includes an igniter connected in parallel with said alarm means.

28. The apparatus of claim 6, wherein said alarm means includes a pair of water connected spaced apart electrodes, a pair of transistors connected together to form a Darlington pair and connected between the power source and said spaced electrodes.

29. The apparatus of claim 1, wherein said alarm means includes a power source.

30. The apparatus of claim 16, further including a closing means on said arm for closing said slot to hold said water deactivating means within said slot.

31. The apparatus of claim 1, further including a water repellant protective film covering said alarm means.

32. The apparatus of claim 21, further including a pair of buoyant structures on said housing.

33. The apparatus of claim 21, further including a water activated circuit for actuating said alarm means.

34. The apparatus of claim 33, wherein said water activated circuit includes a pair of spaced electrodes in said housing which are electrically connected together by the water upon immersion of said housing to complete said circuit.

35. The apparatus of claim 1, wherein said alarm means includes a horn and said predetermined position has said housing oriented to present said horn to emit an alarm signal outwardly of the water when said housing floats on the surface thereof.

36. The apparatus of claim 1, wherein said releasing means includes ejecting means for pushing said housing away from the wearer upon release thereof.

* * * * *